US009599112B2

(12) United States Patent
Durand

(10) Patent No.: US 9,599,112 B2
(45) Date of Patent: Mar. 21, 2017

(54) SWITCHABLE AUTOMOTIVE COOLANT PUMP

(75) Inventor: Jean-Michel Durand, Metz (FR)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 428 days.

(21) Appl. No.: 14/343,051

(22) PCT Filed: Sep. 8, 2011

(86) PCT No.: PCT/EP2011/065532

§ 371 (c)(1),
(2), (4) Date: May 30, 2014

(87) PCT Pub. No.: WO2013/034189

PCT Pub. Date: Mar. 14, 2013

(65) Prior Publication Data

US 2014/0322042 A1 Oct. 30, 2014

(51) Int. Cl.

| | |
|---|---|
| ***F01P 5/12*** | (2006.01) |
| ***F04D 13/02*** | (2006.01) |
| ***F01P 7/16*** | (2006.01) |
| ***F04D 15/00*** | (2006.01) |

(52) U.S. Cl.

CPC ..... *F04D 13/022* (2013.01); *F01P 5/12* (2013.01); *F01P 7/162* (2013.01); *F04D 15/0027* (2013.01)

(58) Field of Classification Search

CPC ..... F04D 13/021; F04D 13/22; F04D 13/026; F04D 13/027; F04D 15/0066;

(Continued)

(56) References Cited

U.S. PATENT DOCUMENTS 4,143,996 A * 3/1979 Sullivan ..... F04B 9/02 417/15
6,007,303 A * 12/1999 Schmidt ..... H02K 49/104 123/41.47

(Continued)

FOREIGN PATENT DOCUMENTS

DE 10 2006 034 960 A1 1/2008
DE 10 2006 039 680 A1 2/2008

(Continued)

OTHER PUBLICATIONS

14343051-ProQuestTrans-DE102010002501 3A1.*

*Primary Examiner* — Theodore Stigell
*Assistant Examiner* — Jon Hoffmann
(74) *Attorney, Agent, or Firm* — Norman B. Thot

(57) ABSTRACT

A automotive coolant pump includes a pulley wheel fixedly supported by a rotatable rotor shaft. A shaft sealing separates a dry pump section from a wet pump section. A pump wheel is supported in the wet pump section by the rotor shaft and is axially slidable between a pumping and a non-pumping position. An actuator is arranged in the dry pump section. A linear actuator rod is arranged in parallel to and eccentrically with respect to the rotor shaft. The linear actuator rod comprises a dry and a wet section. A rod sealing is actuated by the actuator and separates the dry from the wet of the linear actuator rod. A shift ring is arranged so as to be axially shiftable and rotatably fixed at the rotor shaft in the wet pump section. The shift ring is moved axially by the actuator rod and axially moves the pump wheel.

8 Claims, 2 Drawing Sheets

(58) Field of Classification Search
CPC ..... F04D 15/005; F04D 15/0209; F04D 15/0038; F04D 27/002; F04D 27/0246; F04D 29/586; F04D 29/042; F04D 29/052; F04D 29/10; F04D 29/106; F04D 29/12; F04D 13/0225; F04D 13/022; F04D 15/0027; F01P 7/162; F01P 5/12; F01P 7/164; F16D 37/02
USPC ..... 417/223, 316, 319, 362
See application file for complete search history.

(56) References Cited

U.S. PATENT DOCUMENTS

| | | | | |
|---|---|---|---|---|
| 7,475,764 | B2 * | 1/2009 | Schultheiss | F01P 5/12 192/103 R |
| 7,789,049 | B2 * | 9/2010 | Duley | F01P 5/12 123/41.44 |
| 2009/0097996 | A1 * | 4/2009 | Sakumoto | F04D 15/00 417/420 |
| 2010/0006044 | A1 * | 1/2010 | Duley | F01P 7/167 123/41.02 |
| 2011/0129366 | A1 * | 6/2011 | Lee | F16D 27/14 417/410.1 |
| 2012/0076675 | A1 * | 3/2012 | Nomura | B60K 6/445 417/319 |
| 2015/0251644 | A1 * | 9/2015 | Squarcini | B60T 13/52 303/12 |
| 2015/0260240 | A1 * | 9/2015 | Squarcini | F16D 37/02 417/319 |

FOREIGN PATENT DOCUMENTS

| | | | | |
|---|---|---|---|---|
| DE | 10 2010 025 013 | | 1/2011 | |
| DE | 102010025013 | A1 * | 1/2011 | F04D 15/0038 |
| EP | 0 855 515 | A1 | 7/1998 | |
| GB | 002404220 | A * | 1/2005 | F04D 13/02 |

* cited by examiner

SWITCHABLE AUTOMOTIVE COOLANT PUMP

CROSS REFERENCE TO PRIOR APPLICATIONS

This application is a U.S. National Phase application under 35 U.S.C. §371 of International Application No. PCT/EP2011/065532, filed on Sep. 8, 2011. The International Application was published in English on Mar. 14, 2013 as WO 2013/034189 A1 under PCT Article 21 (2).

FIELD

The present invention relates to a switchable mechanical automotive coolant pump for pumping a coolant for cooling an internal combustion engine.

BACKGROUND

Mechanical coolant pumps are directly driven by the internal combustion engine, for example, via a driving belt driving the pulley wheel of the coolant pump. If the pulley wheel is directly connected with the pump wheel, the pump performance depends on the rotational speed of the combustion engine. For allowing a more demand-responsive control of the coolant pump, mechanical coolant pumps can be provided with frictional clutches connecting the pulley wheel with the rotor shaft on demand only. The friction clutch is usually arranged in the dry section of the coolant pump.

DE 10 2006 039 680 A1 describes a switchable mechanical automotive coolant pump with the pump wheel being axially movable between a pumping position and a non-pumping position. The pump wheel is actuated by an actuator rod which is arranged concentrically with and inside of the hollow rotor shaft. This actuation arrangement is complex, expensive to produce, and leads to problems with respect to the sealing between the actuation rod and the rotor shaft.

SUMMARY

An aspect of the present invention is to provide a simple switchable automotive coolant pump with a simple and reliably sealed actuation arrangement.

In an embodiment, the present invention provides a switchable automotive coolant pump which includes a rotor shaft configured to rotate. A pulley wheel is configured to be fixedly supported by the rotor shaft. A shaft sealing is configured to separate a dry pump section from a wet pump section with respect to the rotor shaft. A pump wheel is configured to be supported in the wet pump section by the rotor shaft and to be axially slidable between a pumping position and a non-pumping position. An actuator is arranged in the dry pump section. A linear actuator rod is arranged in parallel to and eccentrically with respect to the rotor shaft. The linear actuator rod comprises a wet section and a dry section. A rod sealing is configured to be actuated by the actuator and to separate the wet section from the dry section of the linear actuator rod. A shift ring is arranged so as to be axially shiftable and rotatably fixed at the rotor shaft in the wet pump section. The shift ring is configured to be moved axially by the actuator rod and to axially move the pump wheel.

BRIEF DESCRIPTION OF THE DRAWINGS

The present invention is described in greater detail below on the basis of embodiments and of the drawings in which.

DETAILED DESCRIPTION

Figure 2:
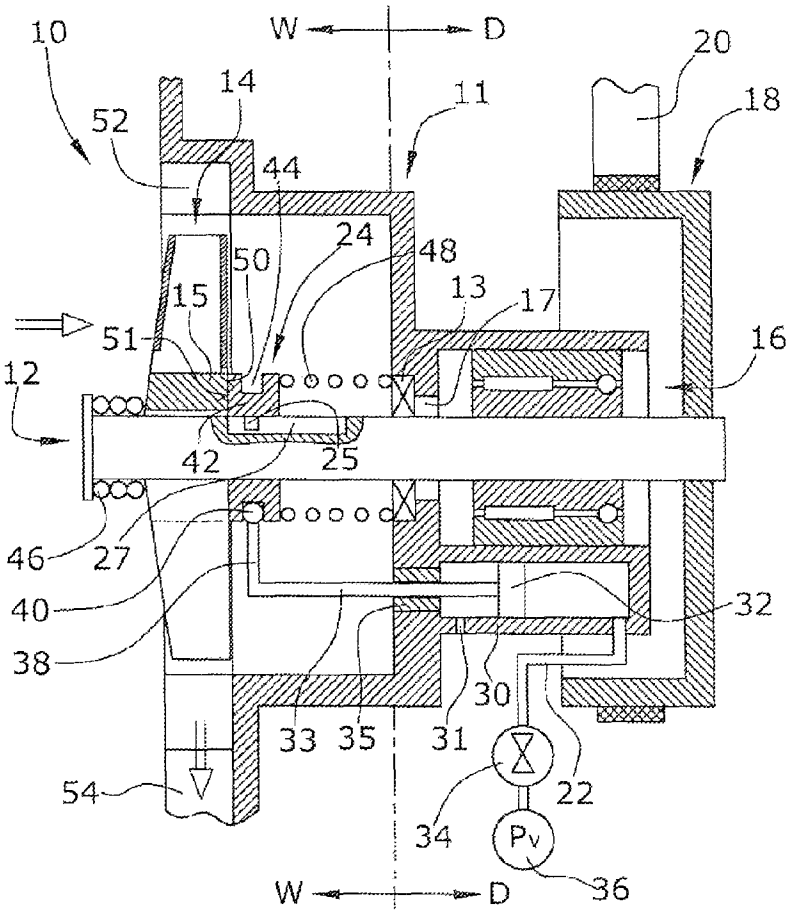
FIG. 2 shows a longitudinal section of the coolant pump of FIG. 1 with the pumping wheel in a pumping position.

In an embodiment of the present invention, the coolant pump is provided with a pulley wheel which is fixedly supported by the rotor shaft so that the pulley wheel always rotates together with the rotor shaft. The coolant pump is provided with a pump housing separating the dry section from the wet section. A shaft sealing seals the ring gap between the rotor shaft and a respective opening edge of the pump housing, thereby separating the rotor shaft into a dry and a wet section.

The pump wheel is supported by the rotor shaft and is arranged axially slidable between a pumping position and a non-pumping position. In the pumping position, the pump wheel is more or less radially in-line with the circular outlet channel; in the non-pumping position, the pump wheel is not in-line with the outlet channel. The pumping performance of the pump is therefore significantly reduced in the axial non-pumping position of the pump wheel even if the pump unit is still rotating. The pumping performance is low if the pump wheel is shifted into its axial non-pumping position, and is close to zero if the pump wheel thereby is even not rotating.

A linear actuator rod is arranged in parallel to the rotor shaft but eccentrically with respect to the rotor shaft. In other words, the actuator rod is arranged outside the rotor shaft so that the rotor shaft is not necessarily hollow. A separate rod sealing is provided to seal the circular gap between the actuator rod and an opening edge of the pump housing separating the wet and the dry section. The actuator rod only performs linear movements with respect to the rod sealing. The actuator rod is actuated by an actuator arranged in the dry pump section. The actuator can be arranged with a radial distance to the axis of the pump.

A shift ring is arranged axially shiftable and rotatably fixed at the rotor shaft in the wet pump section so that the shift ring always co-rotates with the shaft. The shift ring is axially arranged between the pump wheel and the shaft sealing. The shift ring is axially moved by the actuator rod and thereby axially moves the pump wheel between the pumping position and the non-pumping position. The pumping position of the shift ring and of the pump wheel generally can be its distal or proximal position. If the pumping position is the distal position, the shift ring pushes the pump wheel into the pumping position. If the pumping position is the proximal position, the shift ring pulls the pump wheel it into the pumping position.

Since the actuation arrangement is not arranged co-axially with the shaft, but is arranged with a radial distance from the shaft, the axial dimension of the coolant pump can be kept very compact. The sealings for the shaft and the actuation rod can additionally be respectively adapted to and specialized for a rotating part or a shifting part, respectively, and need not be adapted to a single rotating and shifting part. The sealing quality is therefore improved.

In an embodiment of the present invention, the shift ring and the pump wheel can, for example, be separate parts, which can be axially separated or pushed together. The shift ring can axially push or pull the pump wheel. The pump wheel can, for example, not be co-rotatably connected to the rotor shaft so that the pump rotor is rotatable relative to the rotor shaft. The shift ring itself is additionally directly co-rotatably connected to the rotor shaft so that the shift ring always co-rotates with the rotor shaft with the same rotational speed. In this arrangement, the shift ring and the pump rotor define friction rings of a friction clutch which is engaged in the axial pumping position of the shift ring and the pump, and is disengaged in the non-pumping position of the pump wheel and the shift ring. Since the clutch defined by the shift ring and the pump wheel is not engaged in the non-pumping position, the rotational speed of the pump wheel is reduced significantly relative to the rotational speed of the rotor shaft. The pumping performance of the coolant pump is thereby significantly reduced in the disengaged non-pumping state.

In an embodiment of the present invention, the pump wheel can, for example, be axially guided at the rotor shaft so that the pump wheel is co-rotatably engaged with the rotor shaft. The pump wheel is not rotatable relative to the rotatable rotor shaft. In this embodiment, the shift ring can be totally fixed to the pump wheel because no friction clutch is provided to transfer the rotation from the shift ring to the pump wheel.

In an embodiment of the present invention, the shift ring can, for example, be biased by a preload spring into one position, and can, for example, be biased into the pumping position. This makes the coolant pump failsafe in case the rod actuator fails.

The actuator can, for example, be a pneumatic device such as, for example, a plunger-cylinder device. The pneumatic device is mechanically simple, reliable and cost effective in production.

Two embodiments of the present invention are hereafter described with reference to the enclosed drawings.

FIGS. 1 to 4 show a switchable automotive coolant pump 10;10' for pumping a coolant such as water in a coolant circuit for cooling an internal combustion engine (not shown). The coolant pump 10;10' is suitable to be mounted to the engine and to be driven by the engine via a driving belt 20 driving the coolant pumps pulley wheel 18 so that the pulley wheel 18 of the coolant pump 10;10' always rotates with a rotational speed proportional to the engine's rotational speed.

The coolant pump 10;10' is provided with a housing 11 separating a wet section W from a dry section D. The housing 11 supports the shaft bearing 16 in the dry section D, the shaft bearing 16 thereby supporting the rotatable rotor shaft 12;12'. The pulley wheel 18 is totally fixed to the rotor shaft 12. The rotor shaft 12 protrudes through an opening 17 of the housing 11 wherein a ring-like shaft sealing 13 is provided to seal a circular gap between the opening edge of the opening 17 and the rotor shaft 12. The shaft sealing 13 thereby separates the dry section D from the wet section W with respect to the rotor shaft 12; 12'.

The wet end of the rotor shaft 12 supports the impeller-like pump wheel 14; 14' including a wheel hub 15;15' and supports a shift ring 24; 24'. The pump wheel 14; 14' as well as the respective shift ring 24; 24' are provided axially slidable at the rotor shaft 12. The pump wheel 14; 14' as well as the shift ring 24; 24' are axially slidable between a non-pumping position shown in FIGS. 1 and 3 and a pumping position shown in FIGS. 2 and 4. In the pumping position, the pump wheel 14; 14' is shifted to its axial distal position so that the pump wheel 14; 14' is radially in alignment with a circumferential outlet channel 52 leading into a radial outlet channel 54. In the non-pumping position, the pump wheel 14; 14' is in its proximal axial position so that the pump wheel 14; 14' is radially not in alignment with the circumferential outlet channel 52. In the non-pumping position, the pumping performance of the coolant pump is significantly reduced, even if the pump wheel 14; 14' still co-rotates with the rotor shaft 12, as it is the case in the embodiment shown in FIGS. 3 and 4.

The coolant pump 10; 10' is provided with an actuation arrangement comprising a pneumatic actuator 22 and an actuator rod 33. The pneumatic actuator 22 and the actuator rod 33 are arranged radially outside of and adjacent to the shaft bearing 16. The pneumatic actuator 22 is provided with a plunger 32 axially moving in an actuator cylinder 30. The distal end of the actuator cylinder 30 is connected to a vacuum source 36 via an air pipe and a valve 34. The vacuum source 36 can be the permanent vacuum reservoir of the engine or can be, as in the present embodiments, a separate vacuum pump. The proximal end of the actuator cylinder 30 is provided with a venting bore 31 so that the proximal side of the plunger 32 is always provided with atmospheric pressure.

The actuator rod 33 is provided with a radial arm 38 and an actuator rod pin 40 which is arranged within a circular shift ring groove 44 of the shift ring 24; 24'. The actuator rod 33 is non-rotatably guided so that the actuator rod pin 40 always remains within the circular shift ring groove 44. The pump housing 11 is provided with a ring-like rod sealing 35 sealing the circular gap between a circular opening edge and the actuator rod 33, thereby separating the dry section D from the wet section W.

Figure 1:
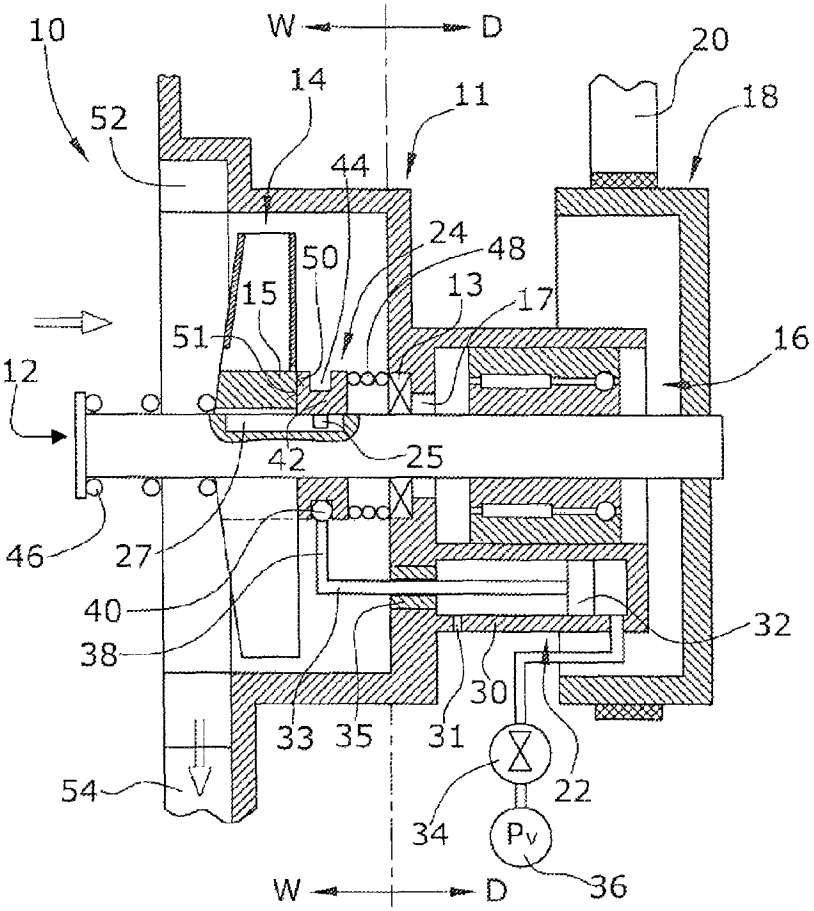
FIG. 1 shows a longitudinal section of an embodiment of a switchable automotive coolant pump with a pumping wheel in its non-pumping position.

In the embodiment of FIGS. 1 and 2, the pump wheel 14 and, in particular, the wheel hub 15 is provided rotatably with respect to the rotor shaft 12. The shift ring 24 is preloaded into its pumping position shown in FIG. 2 by a preload spring 48 so that the shift ring 24 and the pumping wheel 14 are pushed into the pumping position, respectively, if the pneumatic actuator 22 should fail. The pumping wheel 14 is pushed by the clutch spring 46 counteractive to the preload spring 48 into the disengaged direction. The axial length of the clutch spring 46 is dimensioned so that in the non-pumping position of the pumping wheel 14 the clutch spring 36 is totally unstressed so that no spring force at all is generated by the clutch spring 46 anymore.

The axial movement of the pump wheel 14 is restricted by mechanical rotor shaft stops (not shown) axially defining the pumping end position and the non-pumping end position of the pump wheel 14. In addition or alternatively, the non-pumping shaft stop is arranged so that an axial gap between the pump wheel 14 and the shift ring 24 remains in the non-pumping position of the actuator 22 as shown in FIG. 1. As a consequence, the pump wheel 14 can rotate more slowly than the rotor shaft 12 or even stand still in the non-pumping state of the actuator 22 including the shift ring 24.

The ring body 42 of the shift ring 24 is provided with a guiding nose 25 which is guided in an axial guiding slit 27 of the rotor shaft 12 so that the shift ring 24 is always co-rotating with the rotor shaft 12. The proximal surface 50 of the pump wheel hub 15 and the distal surface 51 of the shift ring 24 define clutch discs of a rotational clutch. In the pumping position of the pumping wheel 14 and the shift ring 24, the proximal surface 50 and the distal surface 51 are pushed together by the clutch spring 46 and the preload spring 48 so that the rotation of the rotor shaft 12 is transmitted to the pump wheel 14 without any friction.

Figure 4:
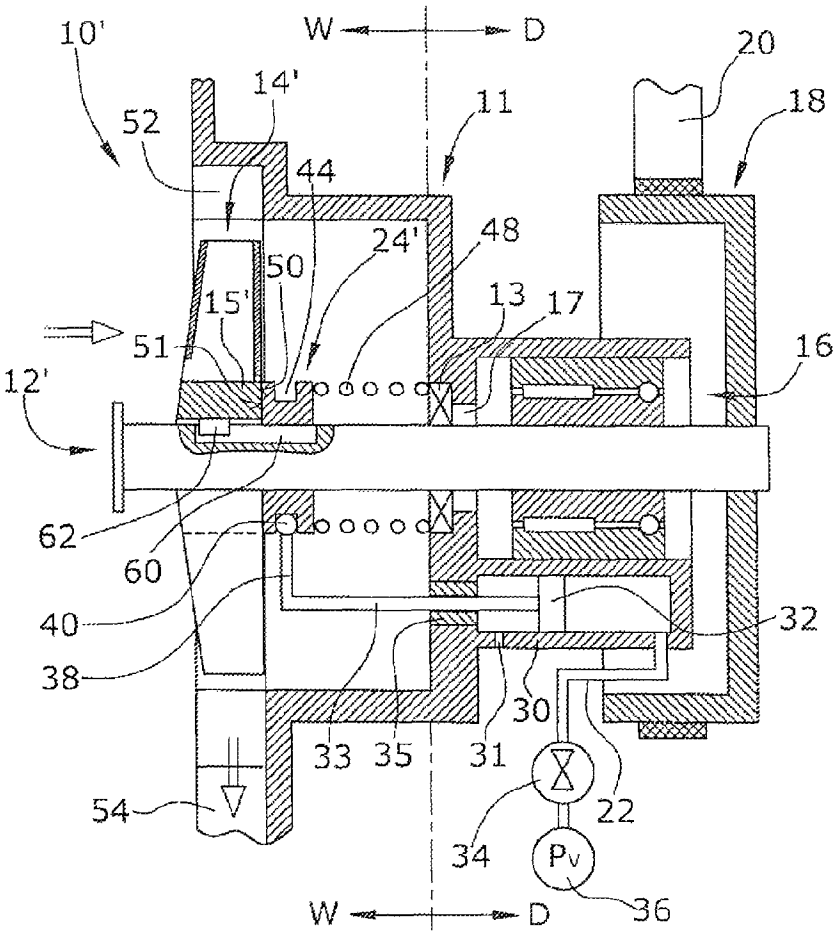
FIG. 4 shows a longitudinal section of the coolant pump of FIG. 3 with the pumping wheel in the pumping position.
Figure 3:
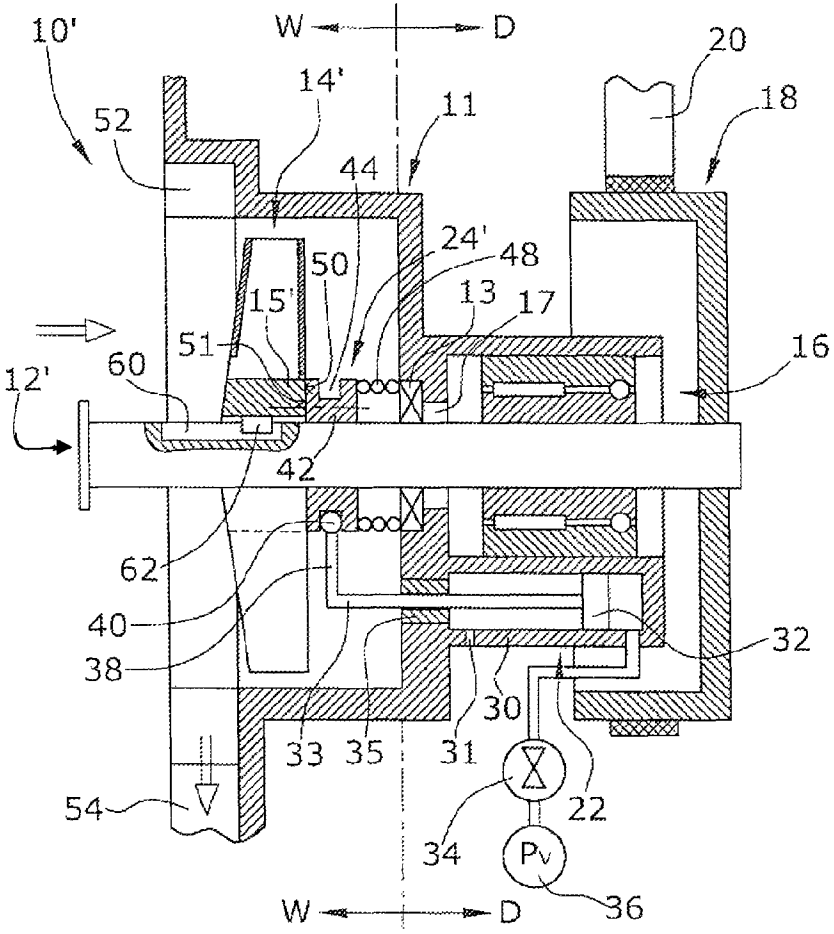
FIG. 3 shows a longitudinal section of an embodiment of the switchable automotive coolant pump with the pumping wheel in the non-pumping position.

In the embodiment of the coolant pump 10' shown in FIGS. 3 and 4, the pump wheel hub 15' of the pump wheel 14' is fixedly connected to the shift ring 24'. Therefore, no clutch spring is necessary. A guiding nose 62 guided in a guiding slit 60 of the rotor shaft 12' is provided at the pump wheel hub 15' so that the pump wheel 14' is always co-rotating with the rotor shaft 12'. The shift ring 24' can be fixed to the wheel hub 15' by screws or any other means, but is not necessarily a separate part.

The present invention is not limited to embodiments described herein; reference should be had to the appended claims.

What is claimed is:

1. A switchable automotive coolant pump comprising:

a rotor shaft configured to rotate;

a pulley wheel configured to be fixedly supported by the rotor shaft;

a shaft sealing configured to separate a dry pump section from a wet pump section with respect to the rotor shaft;

a pump wheel configured to be supported in the wet pump section by the rotor shaft and to be axially slidable between a pumping position and a non-pumping position;

an actuator arranged in the dry pump section;

a linear actuator rod arranged in parallel to and eccentrically with respect to the rotor shaft, the linear actuator rod comprising a wet section and a dry section;

a rod sealing configured to be actuated by the actuator and to separate the wet section from the dry section of the linear actuator rod; and a shift ring arranged so as to be axially shiftable and rotatably fixed at the rotor shaft in the wet pump section, the shift ring being configured to be moved axially by the actuator rod and to axially move the pump wheel.

2. The switchable automotive coolant pump as recited in claim 1, wherein the shift ring and the pump wheel are provided as separate parts which are configured to be axially separated or pushed together.

3. The switchable automotive coolant pump as recited in claim 1, wherein the pump wheel is further configured to rotate with respect to the rotor shaft, and the shift ring and the pump wheel define friction rings of a friction clutch.

4. The switchable automotive coolant pump as recited in claim 1, wherein the pump wheel is configured to be axially guided at the rotor shaft so that the pump wheel does not rotate relative to the rotor shaft.

5. The switchable automotive coolant pump as recited in claim 1, further comprising a preload spring configured to bias the shift ring in a position.

6. The switchable automotive coolant pump as recited in claim 5, wherein the position is the pumping position.

7. The switchable automotive coolant pump as recited in claim 1, wherein the actuator is a pneumatic device.

8. The switchable automotive coolant pump as recited in claim 7, wherein the pneumatic device is a plunger-cylinder device.

* * * * *